US005386984A

United States Patent [19]

Dal Toso et al.

[11] Patent Number: 5,386,984

[45] Date of Patent: Feb. 7, 1995

[54] SEPARATING DEVICE

[75] Inventors: Mauro Dal Toso, Rapallo; Mauro Levaro; Michele Scarnera, both of Genoa, all of Italy

[73] Assignee: Finmeccanica S.p.A., Rome, Italy

[21] Appl. No.: 157,251

[22] Filed: Nov. 26, 1993

[30] Foreign Application Priority Data

Apr. 9, 1993 [IT] Italy ..... TO93A000246

[51] Int. Cl.[6] ..... B65H 3/52

[52] U.S. Cl. ..... 271/122; 271/272; 271/182; 271/270; 271/259; 271/265

[58] Field of Search ..... 271/259, 258, 265, 270, 271/182, 272–274, 122; 198/460, 461, 622

[56] References Cited

U.S. PATENT DOCUMENTS 3,827,545 8/1974 Buhayar ..... 198/461
4,863,154 9/1989 Hirakawa et al. ..... 271/270 X
5,257,777 11/1993 Kalika et al. ..... 271/259 X

FOREIGN PATENT DOCUMENTS 0060596 5/1985 European Pat. Off. .

*Primary Examiner*—David H. Bollinger
*Attorney, Agent, or Firm*—Shlesinger, Arkwright & Garvey

[57] ABSTRACT

A separating device wherein two belts with different friction coefficients present respective straight portions facing each other and converging at a contact portion. The belts are fed with a number of mail items which are wedged in the V-shaped opening defined by the straight portions and are fed singly through the contact portion by the higher friction coefficient belt and to the input of a follow-up conveyor belt system. The device comprises a barrier of sensors located between the contact portion and the input of the conveyor belt system, and which provide for determining the form and spacing of the mail items. The signal generated by the barrier of sensors is used for adjusting operation of the higher friction coefficient belt.

20 Claims, 3 Drawing Sheets

SEPARATING DEVICE

BACKGROUND OF THE INVENTION

The present invention relates to a separating device for mail items.

Separating devices are known which are fed at the input with packs of mail items (letters and postcards), and which provide for forming at the output a substantially orderly stream of linearly spaced items.

Known separating devices feature either permeable belts or perforated drums, which, with the aid of a vacuum pump, suck one item at a time off the pack and feed it to a follow-up conveyor line.

In addition to being highly complex, devices of the aforementioned type present a limited output capacity, and fail to provide for adjusting the characteristics of the output stream.

Other known mail separating devices, such as that described in European Patent EP-60.596 filed by Elettronica San Giorgio-ELSAG S.p.A., feature a pair of endless belts having straight portions converging at an acute angle and maintained elastically contacting each other at a contact portion corresponding to the apex of the acute angle. The two belts present widely differing friction coefficients, and travel in opposite directions.

The belts are fed with a stream of mail items, which are wedged inside the V-shaped opening defined by the straight portions of the belts, and are fed one at a time through the contact portion by the higher friction coefficient belt and on to a follow-up conveyor belt system on which the items are arranged in an orderly stream with a normally constant gap between the adjacent portions.

Devices of the aforementioned type fail to provide for adjusting the gap between the adjacent portions of the items in the output stream, or for producing an output stream wherein the leading edges of the items present a constant pitch.

SUMMARY OF THE INVENTION

It is an object of the present invention to provide a perfected device of the type described in European Patent EP-60,596, by enabling control of the output stream.

According to the present invention, there is provided a separating device for mail items, particularly flat, rectangular mail items, comprising:

first and second belts having respective first and second substantially straight portions facing each other and defining an acute angle ($\alpha$);

said straight portions being maintained elastically contacting each other at a contact portion corresponding to the apex of said angle ($\alpha$);

said first belt presenting a higher friction coefficient as compared with said second belt;

said first belt traveling in the opposite direction to said second belt by virtue of drive means;

said contact portion terminating in a separating portion at which said belts diverge to define a separating output;

a conveyor system consisting of at least two powered belts having elastically adjacent portions defining a conveyor portion extending from an input facing said separating output and at which said belts converge with each other;

said separating device cooperating with means for feeding a number of mail items into the V-shaped opening defined by said first and second straight portions;

said mail items being fed one at a time through said contact portion by said first belt and into said input of said conveyor system, which provides for conveying a stream of mail items having mutually spaced adjacent portions (F, B); characterized by the fact that it comprises:

sensor means located along a path extending between said separating output and said input of said conveyor system;

said sensor means detecting at least the gap (Gi) between the items traveling along said path;

an electronic control unit connected at the input to said sensor means and driving said drive means at the output;

said control unit comprising means for controlling said drive means and adjusting the operation of said first belt on the basis of information supplied by said sensor means and as a function of the separating mode selected.

BRIEF DESCRIPTION OF THE DRAWINGS

A preferred non-limiting embodiment of the present invention will be described by way of example with reference to the accompanying drawings, in which.

DETAILED DESCRIPTION OF THE INVENTION

Figure 1:
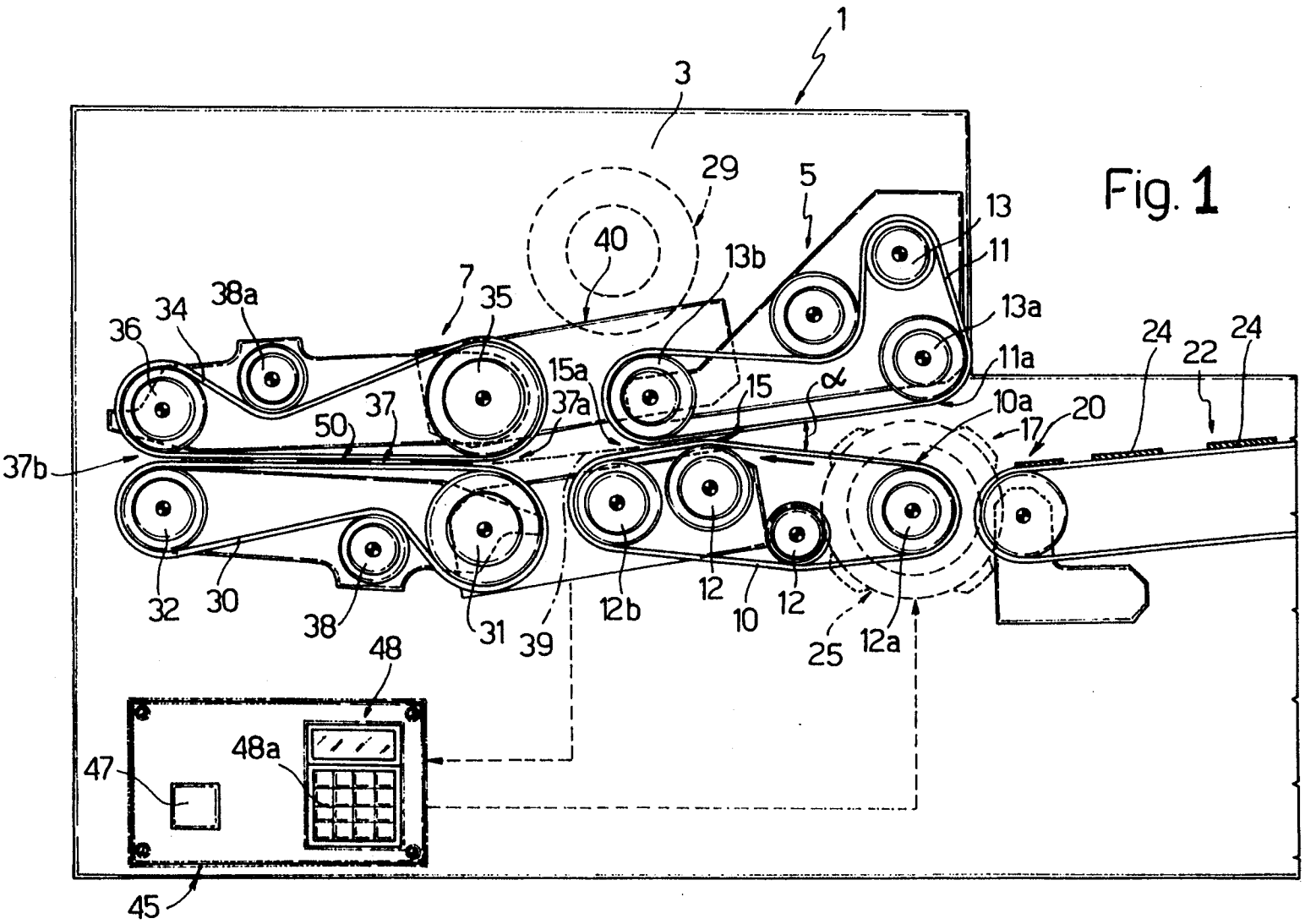
FIG. 1 shows a simplified side view of a separating device in accordance with the teachings of the present invention.

Number 1 in FIG. 1 indicates a separating device wherein a vertical plate 3 supports a separating unit 5 and an adjacent conveyor belt device 7.

Separating unit 5 comprises two endless belts 10, 11 looped about respective pulleys 12, 13 fitted to plate 3, and having respective first and second straight portions 10*a*, 11*a* facing and converging with each other.

More specifically, first and second straight portions 10*a*, 11*a* form an acute angle ($\alpha$) of roughly 10°, and extend between respective pulleys 12*a*, 13*a* and a contact portion 15 substantially corresponding to the apex of the acute angle and at which belts 10, 11 are pressed together by an elastic system (not shown) partially supporting pulleys 12, 13.

First and second straight portions 10*a*, 11*a* thus define a V-shaped opening 17 with its apex at contact portion 15 and its open end facing the output 20 of a conveyor belt system 22 (shown partially) for withdrawing a number of flat, rectangular mail items 24 (e.g. letters and postcards) from a loading device (not shown) and feeding them to separating unit 5.

At a separating portion downstream from portion 15, belts 10, 11 diverge about respective pulleys 12*b*, 13*b* to define the output 15*a* of separating unit 5.

Belt 10 presents a higher friction coefficient as compared with belt 11, and is powered by a low-inertia electric motor 25, in particular a brushless motor, so as to travel in the direction of the arrow between pulley 12*a* and portion 15.

Belt 11 is operated in the opposite direction and at a slower speed as compared with belt 10 by an asynchronous motor 29 fitted to plate 3 and operating pulleys 13 via a belt drive (not shown).

Conveyor device 7 comprises an endless bottom belt 30 looped about two end pulleys 31, 32; and an endless top belt 34 looped about two end pulleys 35, 36, and which, together with belt 30, defines a conveyor portion 37 extending between input 37*a*, where belts 30, 34 converge about pulleys 31, 35, and output 37*b* where belts 30, 34 diverge about pulleys 32, 36.

Belts 30, 34 also present external tensioning rollers 38, 38*a*, and are powered at constant speed (V) and in the same direction between input 37*a* and output 37*b* by asynchronous motor 29 to which they are connected via a belt drive (not shown).

Input 37*a* of conveyor portion 37 faces output 15*a*, and receives mail items 24 coming from output 15*a* along a substantially straight path 39 (shown by the dotted line) extending between output 15*a* and input 37*a*.

According to the present invention, a position sensing device 40 is provided between output 15*a* of unit 5 and input 37*a* of conveyor device 7.

Figure 2:
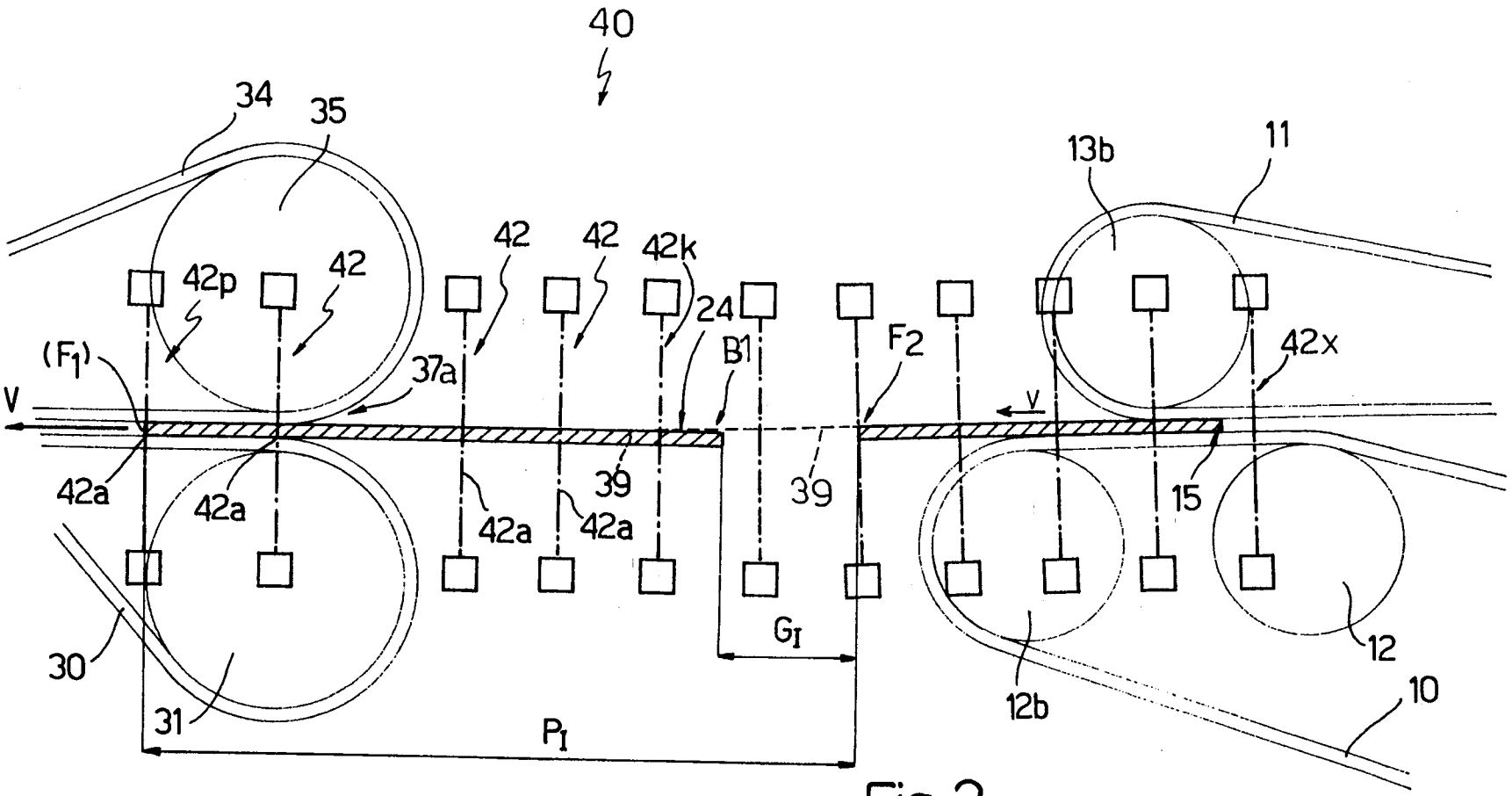
FIG. 2 shows a larger-scale detail of the FIG. 1 device.

As shown in FIG. 2, position sensing device 40 consists of a barrier of eleven optoelectronic sensors 42 defining optical paths 42a perpendicular to and equally spaced along path 39. More specifically, one optoelectronic sensor 42*p* is located at input 37*a*, and another 42*x* at contact portion 15 of belts 10, 11.

According to the present invention, separating device 1 also presents an electronic control unit 45 (FIG. 1) connected at the input to sensing device 40, and at the output, via the interposition of a power controller circuit 47, to brushless motor 25 powering belt 10.

Unit 45 presents a control keyboard 48 with a number of alphanumeric keys 48*a* for selecting and modifying operation of separating device 1.

In actual use, mail items 24 are fed by conveyor belt system 22 to belt 10 by which they are fed to contact portion 15 and wedged inside the V-shaped opening 17 defined by portions 10*a*, 11*a*.

More specifically, by virtue of the high friction coefficient of belt 10, this tends to draw items 24 towards contact portion 15, while belt 11, which travels in the opposite direction and presents a low friction coefficient, tends to hold back items 24 sliding against it.

A single item 24 engaged between belts 10, 11 at contact portion 15 is thus pushed forward towards device 7 by belt 10, and pushed backwards by belt 11.

As the pressure on the two faces of items 24 is the same, whereas the friction coefficient of belt 10 is greater than that of belt 11, the forward pushing action of belt 10 predominates so as to feed item 24 in the direction of the arrow and at the speed (v) of belt 10.

In the event two items 24 are fed simultaneously to contact portion 15, the one contacting belt 10 is fed forward to conveyor device 7, while the one contacting belt 11 is fed backby belt 11 and positioned close to portion 15 until the item withdrawn by belt 10 emerges from output 15*a*, thus clearing belt 10, which then engages the waiting item and feeds it forward.

Items 24 thus emerge one at a time from output 15*a* of separating unit 5, and are fed along path 39 and through sensing device 40 into input 37*a* of conveyor portion 37.

Belts 30, 34 travel at a speed (V) greater than that (v) of belt 10, and exert greater pressure on item 24 than that exerted by belt 10, so that, on entering input 37*a*, item 24 adapts immediately to the speed (V) of belts 30, 34, and is thus separated from the following item 24 still retained by belt 10 and traveling at speed (v).

As a result, a gap is formed between the adjacent facing portions of the two items 24.

Conveyor portion 37 thus provides for transporting a stream 50 of separate items 24, i.e. having the adjacent facing edges separated by a gap.

The present invention provides for controlling the gap between the separated items 24. More specifically, separating device 1 may function according to a first operating mode, wherein items 24 are separated by a predetermined gap Gi in excess of a given threshold value (constant gap mode); or according to a second operating mode wherein the leading edges of the separated items 24 are separated by a constant distance (pitch) P1 equal to a predetermined value (constant pitch mode).

Separating device 1 may also function according to a third operating mode, wherein items 24 are expelled from unit 5 in response to an external sync signal.

Figure 3:
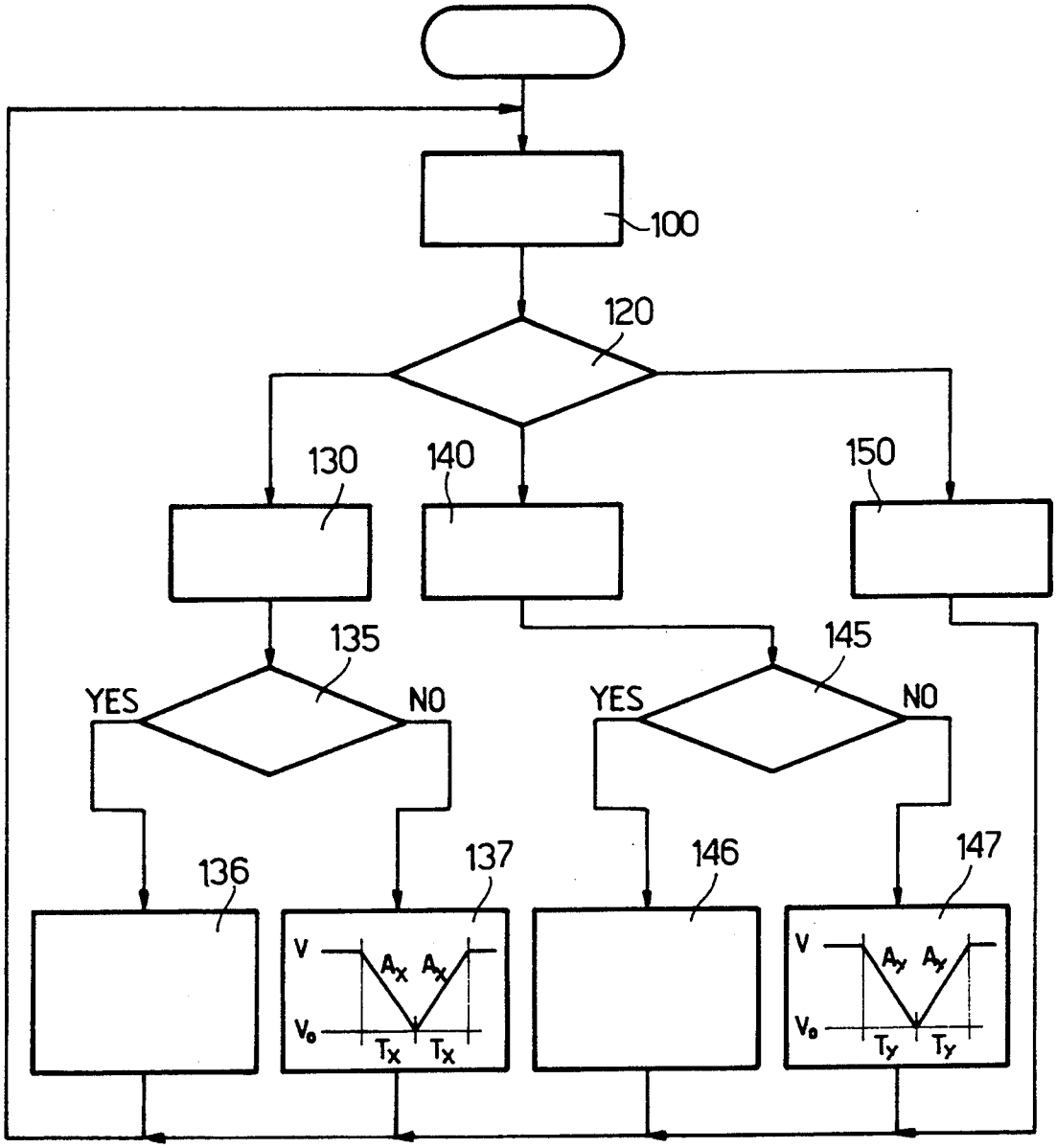
FIG. 3 shows a operating block diagram of the FIG. 1 device.

Operation of electronic control unit 45 governing the three operating modes according to the present invention will now be described with reference to the block diagram in FIG. 3.

To begin with, by means of sensing device 40, a starting block 100 measures the length Li of item 24 expelled from separating unit 5 and being fed into input 37*a* of conveyor portion 37. Block 100 also provides for measuring the gap Gi between the rear end of item 24 entering input 37*a* and the leading edge of the following item 24 still retained by belt 10.

The above measurements are effected with the aid of optoelectronic sensors 42. More specifically, upon the leading edge F1 of item 24 (FIG. 2) intercepting the optical path of optoelectronic sensor 42*p* (at input 37*a*), this terminates separation of a first item 24, and a counter (not shown) in electronic unit 45 is activated. As of this instant, the following events are observed:

the optical path of a generic sensor 42*k* is reset at time Ti (by the rear end B1 of the first item 24 moving forward);

the optical path of sensor 42*k* is intercepted at time Tj (by the arrival of leading edge F2 of a second item 24).

The first event enables the length Li of the first item 24 to be determined according to the equation:

$$Li = Ti*(V) + D(42p - 42k) \quad (1)$$

where V is the traveling speed of portion 37, and D(42*p*−42*k*) is the distance between the optical paths of sensors 42*k*−42*p*.

The second event enables the pitch Pi between the leading edges of the first and second items 24 to be determined according to the equation:

$$Pi = (Tj - Ti)*(v) + D(42p - 42k) \quad (2)$$

where v is the speed of belt 10.

Gap Gi between the adjacent portions of items 24 (i.e. between rear end B1 of the first item entering conveyor portion 37, and leading edge F2 of the second item still retained by belt 10) is therefore given by the equation:

$$Gi = Pi - Li \quad (3)$$

Block 100 is followed by block 120, which determines whether device 1 is to be operated in constant gap, constant pitch or external sync mode, which modes are selectable, for example, using keys 48a on keyboard 48.

In the event the first, second or third mode is selected, block 120 goes on to block 130, 140 or 150 respectively.

Block 130 provides for reading a previously set gap value Gs stored in a memory (not shown) in electronic unit 45.

Block 130 is followed by block 135, which provides for comparing the gap value Gi measured in block 100 with the set gap value Gs. If the measured gap value Gi is substantially equal to the set value in block 130, block 135 goes on to block 136, which maintains a constant speed of motor 25 (and, hence, a constant speed v of belt 10) so as to leave the gap between items 24 unchanged. Conversely, if the measured gap value Gi is below the set value in block 130, block 135 goes on to block 137, which provides for correcting the gap by adjusting the speed of motor 25.

This is made possible by virtue of the rear edge of the gap being defined by the leading edge of the item retained by belt 10, so that slowing down belt 10 (and item 24 retained by it) provides for widening the gap.

More specifically, for correcting the gap, motor 25 is decelerated by a constant amount Ax and for a time Tx depending on the error Eg between the measured and memorized gaps Gi and Gs, and is subsequently accelerated for a time Tx, equal to the deceleration time, so as to bring it back up to the pre-deceleration speed (v). The value of time Tx can be calculated by means of straightforward kinematic laws, such as:

$$Tx = \sqrt{Eg/Ax} \tag{4}$$

When so corrected, the gap between the adjacent portions of items 24 entering input 37a of portion 37 is substantially equal to the set value Gs.

Block 140 provides for reading a previously set pitch value Ps stored in a memory (not shown) in electronic unit 45.

Block 140 then goes on to block 145, which compares the measured pitch value Pi in block 100 with the set value Ps. If the measured pitch value Pi is substantially equal to the set value, block 145 goes on to block 146, which maintains a constant speed of motor 25 (and belt 10) so that the gap Gi (and, hence, pitch Pi) of items 24 remains unchanged. Conversely, if the measured pitch value Pi is below the set value in block 145, block 145 goes on to block 147, which provides for correcting the pitch by adjusting the speed of motor 25.

This is made possible by virtue of the rear edge of the gap being defined by the leading edge of the item retained by belt 10, so that slowing down belt 10 (and item 24 retained by it) provides for widening the gap and so increasing the pitch.

More specifically, for correcting the pitch, motor 25 is decelerated by a constant amount Ay and for a time Ty depending on the error Ep between the measured and memorized pitch values Pi and Ps, and is subsequently accelerated by a constant amount and for a time equal to deceleration time Ty, so as to bring it back up to speed (v). The value of time Ty can be calculated by means of straightforward kinematic laws, such as:

$$Ty = \sqrt{Ep/Ay} \tag{5}$$

When so corrected, the pitch between the leading edges of items 24 entering input 37a of portion 37 is substantially equal to the set value Ps.

Block 150 provides for stopping motor 25 when an item 24 is engaged between belts 10 and 11, and awaits an external sync signal from a remote control unit (not shown) connected to electronic unit 45. On receiving the sync signal, block 150 starts and linearly accelerates motor 25 so as to hurl item 24 into input 37a, which is penetrated by item 24 after a lapse of time T from reception of the external sync signal.

Block 150 then goes back to block 100.

The device according to the present invention therefore clearly provides for improving that described in European Patent EP-60,596.

Device 1 in fact ensures (in constant gap mode) constant spacing of the separated items, and prevents the gap between the items from falling below a given set value.

Device 1 also provides for forming a stream of items 24 wherein the leading edges of the items are separated by a constant distance (pitch) Pi.

Device 1 may also provide for extracting single items 24 in response to an external control signal.

To those skilled in the art it will be clear that changes may be made to the device as described and illustrated herein without, however, departing from the scope of the present invention.

In the event the gap between items 24 exceeds the threshold value, spacing of the items may be corrected by first accelerating and then decelerating motor 25.

We claim:

1. A separating device for mail items, particularly flat, rectangular mail items, comprising:

a) first and second belts having respective first and second substantially straight portions facing each other and defining an acute angle ($\alpha$);

said straight portions of said first and second belts contacting each other at a contact portion corresponding to the apex of said angle ($\alpha$);

said first belt having a higher friction coefficient as compared with said second belt;

said first belt traveling in the opposite direction to said second belt by virtue of drive means, said second belt including a drive means;

said contact portion terminating in a separating portion at which said belts diverge to define a separating output;

b) a conveyor system including at least two powered belts having adjacent surfaces defining a conveyor portion extending from an input facing said separating output and at which said belts converge with each other;

said separating device adapted to receive a number of mail items into a V-shaped opening defined by said first and second straight portions;

the mail items being fed one at a time through said contact portion by said first belt and into said input of said conveyor system, which provides for conveying a stream of mail items having mutually spaced adjacent portions;

c) sensor means located along a path extending between said separating output and said input of said conveyor system;

said sensor means detecting at least the gap (Gi) between the items traveling along said path;

d) an electronic control unit having an input and an output, said input of said electronic control unit operably connected to said sensor means said drive means connected to said control unit output whereby said sensor means driving said drive means; and said control unit including means for controlling the output of said drive means to adjust the operation of said first belt on the basis of information supplied by said sensor means.

2. A device as claimed in claim 1, and wherein said controlling means for adjusting operation of said first belt including means for establishing a predetermined distance between separate mail items so that adjacent portions of mail items are separated by a constant distance (Gi) substantially equal to a given set value (Gs).

3. A device as claimed in claim 1, and wherein said controlling means for adjusting operation of said first belt including means for establishing a predetermined distance between separate mail items so that respective leading edges of mail items are separated by a constant distance (Pi).

4. A device as claimed in claim 1, and wherein said controlling means for adjusting operation of said first belt including means for starting said first belt in response to an external control signal whereby a mail item is fed into said input of said conveyor system after a given lapse of time (T) following reception of said external control signal.

5. A device as claimed in claim 1, and wherein said controlling means comprising electronic measuring means cooperating with said sensor means for determining at least the distance (Gi) between adjacent portions of mail items traveling along said path;

first electronic means for comparing said measured distance (Gi) with a predetermined distance (Gs);

second electronic means for maintaining a constant speed of said drive means in the event of a positive comparison by said first electronic means; and third electronic means for adjusting acceleration of said drive means in the event said measured distance (Gi) differs from said predetermined distance (Gs).

6. A device as claimed in claim 5, and wherein said third and sixth electronic means provide for correcting the measured distance (Gi, Pi) by decelerating said first belt for a period of time (Tx) depending on the error between said measured distance (Gi; Pi) and said predetermined distance (Gs; Ps).

7. A device as claimed in claim 6, and wherein said third and sixth electronic means provide for correcting said measured distance (Gi, Pi) by decelerating said first belt via constant linear deceleration (Ax) for a period of time (Tx) depending on the error (E) between said measured distance (Gi; Pi) and said predetermined distance (Gs; Ps); said third and sixth electronic means also providing for subsequently accelerating said first belt via constant linear acceleration (Ax) for a time (Tx) substantially equal to said deceleration time.

8. A device as claimed in claim 1, and wherein said controlling means comprising electronic measuring means cooperating with said sensor means for determining at least the distance (Pi) between the respective leading edges of mail items traveling along said path;

fourth electronic means for comparing said measured distance (Pi) with a predetermined pitch value (Ps);

fifth electronic means for maintaining a constant speed of said drive means in the event of a positive comparison by said fourth electronic means; and sixth electronic means for adjusting the acceleration of said drive means in the event said measured distance (Pi) differs from said predetermined pitch value (Gs).

9. A device as claimed in claim 1, and wherein said sensor means comprise a barrier of optoelectronic sensors defining optical paths perpendicular to said path.

10. A device as claimed in claim 9, and wherein said electronic measuring means provide for determining the length (Li) of the mail items traveling along said path, and the distance (Gi) between the rear portion and the leading edge of adjacent mail items on the basis of information obtained from interruption and subsequent resetting of at least part of said optical paths.

11. A device as claimed in claim 1, and wherein said drive means comprise a low-inertia motor.

12. A device as claimed in claim 11, and wherein said low-inertia motor comprises a brushless motor controlled electronically by said control unit.

13. An apparatus for selectively separating and spacing discrete mail items, especially flat mail items comprising:

a) first and second endless belts having first and second straight portions respectively, said first and second straight portions aligned along a common vertical plane and converging to form a nip region therebetween for receiving a conveyed mail item to be separated;

b) drive device operatively associated with said first and second endless belts respectively, said first endless belt traveling in a opposite direction to said second endless belt by virtue of said drive device;

c) said first and second straight portions diverging at a separating output to discharge the conveyed mail item therefrom;

d) a conveyor system including a cooperating pair of endless belts having adjacent surfaces defining a conveying portion extending from an input at one end thereof to an output at an opposite end thereof, said conveyor system input facing said separating output to receive a mail item discharged therefrom;

e) sensor device adapted to monitor a path extending from said separating output to said conveyor system input to detect at least the gap between mail items traveling along said path;

f) electronic control unit having an input and an output, said control unit input operatively associated with said sensor device and said control unit output operatively associated with said drive device whereby said sensor device driving said drive device; and g) said control unit including means for controlling the output of said drive device to selectively adjust the operation of said first endless belt on the basis of information supplied by said sensor device.

14. A device as claimed in claim 13, and wherein:

a) said controlling means for adjusting operation of said first belt including means for establishing a predetermined distance between separate mail items so that adjacent portions of mail items are separated by a constant distance (Gi) substantially equal to a given set value (Gs).

15. A device as claimed in claim 13, and wherein:

a) said controlling means for adjusting operation of said first belt including means for establishing a predetermined distance between separate mail items so that respective leading edges of mail items are separated by a constant distance (Pi).

16. A device as claimed in claim 13, and wherein:

a) said controlling means for adjusting operation of said first belt including means for starting said first belt in response to an external control signal whereby a mail item is fed into said input of said conveyor system after a given lapse of time (T) following reception of said external control signal.

17. A device as claimed in claim 13, and wherein said controlling means further comprising:

a) electronic measuring means cooperating with said sensor device for determining at least the distance (Gi) between adjacent portions of mail items traveling along said path;

b) first electronic means for comparing said measured distance (Gi) with a predetermined distance (Gs);

c) second electronic means for maintaining a constant speed of said drive device in the event of a positive comparison by said first electronic means; and d) third electronic means for adjusting acceleration of said drive device in the event said measured distance (Gi) differs from said predetermined distance (Gs).

18. A device as claimed in claim 17, and wherein said controlling means further comprising:

a) electronic measuring means cooperating with said sensor device for determining at least the distance (Pi) between the respective leading edges of mail items traveling along said path;

b) fourth electronic means for comparing said measured distance (Pi) with a predetermined pitch value (Ps);

c) fifth electronic means for maintaining a constant speed of said drive device in the event of a positive comparison by said fourth electronic means; and d) sixth electronic means for adjusting the acceleration of said drive device in the event said measured distance (Pi) differs from said predetermined pitch value (Gs).

19. A device as claimed in claim 18, and wherein:

a) said third and sixth electronic means provide for correcting the measured distance (Gi, Pi) by decelerating said first endless belt for a period of time (Tx) depending on the error between said measured distance (Gi; Pi) and said predetermined distance (Gs; Ps).

20. A device as claimed in claim 18, and wherein:

a) said third and sixth electronic means provide for correcting said measured distance (Gi, Pi) by decelerating said first endless belt via constant linear deceleration (Ax) for a period of time (Tx) depending on the error (E) between said measured distance (Gi; Pi) and said predetermined distance (Gs; Ps); said third and sixth electronic means also provided for subsequently accelerating said first endless belt via constant linear acceleration (Ax) for a time (Tx) substantially equal to said deceleration time.

* * * * *